United States Patent [19]

Dietrich et al.

[11] Patent Number: 5,061,231

[45] Date of Patent: Oct. 29, 1991

[54] APPARATUS FOR ERECTING BOXES

[75] Inventors: Walter Dietrich; Eberhard Krieger, both of Weinstadt; Siegfried Weber, Rudersberg, all of Fed. Rep. of Germany

[73] Assignee: Robert Bosch GmbH, Stuttgart, Fed. Rep. of Germany

[21] Appl. No.: 568,814

[22] Filed: Aug. 17, 1990

[30] Foreign Application Priority Data

Dec. 19, 1989 [DE] Fed. Rep. of Germany ..... 3941867

[51] Int. Cl.[5] ..... B31B 5/80; B31B 1/78

[52] U.S. Cl. ..... 493/315; 493/317; 271/95; 414/797; 414/797.7

[58] Field of Search ..... 493/309, 315, 317, 319; 271/95; 414/797, 797.7

[56] References Cited

U.S. PATENT DOCUMENTS

| | | | |
|---|---|---|---|
| 3,937,458 | 2/1976 | Laugen | 271/95 |
| 3,956,976 | 5/1976 | Vogel et al. | 493/315 |
| 4,194,442 | 3/1980 | Martelli | 493/315 |
| 4,537,587 | 8/1985 | Laugen | 493/315 |
| 4,596,545 | 6/1986 | Greenwell | 493/315 |
| 4,605,393 | 8/1986 | Krieger et al. | 493/317 |
| 4,854,930 | 8/1989 | Miselli et al. | 493/317 |

FOREIGN PATENT DOCUMENTS

| | | | |
|---|---|---|---|
| 0134628 | 3/1985 | European Pat. Off. . | |
| 2500568 | 7/1976 | Fed. Rep. of Germany | 493/317 |
| 2547132 | 5/1977 | Fed. Rep. of Germany . | |
| 302338 | 9/1950 | Switzerland | 493/317 |

*Primary Examiner*—William E. Terrell

*Attorney, Agent, or Firm*—Edwin E. Greigg; Ronald E. Greigg

[57] ABSTRACT

An apparatus for taking folded flat blanks out of a magazine and transferring them to a conveyor apparatus of a box-making machine is disposed between the vertically oriented magazine and the conveyor apparatus extending horizontally beneath it at some distance therefrom. The apparatus has three suction cups offset by 120°, on a star-shaped rotor which travel over a self-contained cycloid path (C) having four reversal points (F, G, H, I) and concave arcs between them. This cycloid path is generated by a revolving crank that rotatably supports the rotor with an eccentricity (E) and by a planetary gear associated with the crank, the sun gear of which is disposed coaxially with the axis of rotation of the crank, and the planet gear of which is firmly connected coaxially to the rotor; an intermediate gear is incorporated between the sun gear and the planet gear. The gear ratio of the planetary gear is 4:3 between the sun gear and the planet gear, and the spacing (D) of the suction cups from the shaft of the rotor is approximately three times the eccentricity of the crank. For erecting the foldable blank during the transfer, pressing fingers are associated with the suction cups and are pivoted by a control disk supported on the shaft of the rotor.

20 Claims, 3 Drawing Sheets

APPARATUS FOR ERECTING BOXES

BACKGROUND OF THE INVENTION

The invention is based on an apparatus for transferring flat blanks, in particular foldable boxes, from a delivery station to a receiving station, as hereinafter. In an apparatus of this type known for instance from German Patent 25 47 132 and European Patent Document A 1 34 628, two diametrically opposed suction cups revolve on a triangular cycloid path, which has three reversal points with concave arcs between them. This curved path is generated in that the spacing of the suction cups to the axis of rotation of the rotor carrying them is twice the eccentricity of the crank carrying the rotor, and the gear ratio between the sun wheel and the planet wheel is 3:2. The apparatus is disposed such that one reversal point of the triangular cycloid path points downward, and the receiving station, for instance a horizontally extending conveyor chain with carriers in a box-making machine, is associated with this downward-pointing reversal point. The delivery station, which belongs to a supply magazine for the flat articles to be transferred, is associated with one of the other two reversal points of the cycloid path, such that the face end of the magazine and thus the plane of the forward-most article to be taken is located transversely to the direction of motion of a suction cup at the reversal point, or in other words is disposed at an angle of 60° from the horizontal.

Although the known apparatuses may be used for transferring foldable boxes, they have some disadvantages. One substantial disadvantage is that the magazine for the supply of foldable boxes extends above the conveyor path of the erected folded boxes, or in other words above the working region of the box-making machine. This makes monitoring and continuous loading with foldable boxes possible only in the face of obstacles. Moreover, slippage of the foldable boxes in the magazine because of its 30° obliquity is not always certain, which can lead to disruptions of the machine. Moreover, particularly in the apparatus of German Patent 25 47 132, there is only a very brief period of time available to erect the foldable boxes during their transfer from the magazine to the conveyor apparatus of the box-making machine.

OBJECT AND SUMMARY OF THE INVENTION

The apparatus according to the invention has the advantage over the prior art that the magazine opposite the receiving station is oriented vertically, with foldable boxes lying horizontally in it, so that it can be supplied from all sides, and in particular from ahead of the foldable box from the standpoint of the conveyor apparatus of the box-making machine, or in other words from one end of the box-making machine, and that the foldable blank boxes can slip onward in it without hindrance. Another advantage is that because of the small angle of rotation of the suction cups, high cycling rates are possible in the transfer of the foldable boxes. Since an additional reversal point for the suction cups is provided between the delivery station and the receiving station, a relatively long period of time is available for erecting the foldable boxes. If a counterpart suction device is associated with this reversal point, then even foldable boxes that are difficult to open, such as those having a square cross section, can be reliably erected. In view of the known apparatus of German Patent 25 47 132 and European Patent Document A 1 34 628, as well as other conceivable apparatus of this type, with different ratios of length and gear ratios of the members that generate self-contained cycloid paths for the suction cups, the apparatus according to the invention represents an optimum in terms of the attainable yield of foldable boxes and reliable function, while having the same installed dimensions.

The dependent claims herein describe the advantageous features of the new and novel apparatus.

One of the features disclosed herein is particularly advantageous, since the loop-shaped path at the reversal point in the delivery station enables both a very favorable arrival of a suction cup, without transverse shifting, at the lowermost foldable box to be taken, and reliable extraction of the foldable boxes from the retaining dogs of the magazine.

With a further revealed embodiment revealed herein, a flattening of the reversal point of the suction cups in the vicinity of the receiving station is created, so that the transfer speed of the foldable boxes is adapted to the speed of the conveyor apparatus of the box-making machine.

With another advantageous provision, foldable boxes are erected reliably and in a controlled manner as a function of travel, so that in every case, they are transferred, fully opened, to the subsequent conveyor apparatus. This travel-dependent erection makes it possible to associate guides and folder elements, with which the foldable tab means which protrude from the end of the foldable boxes are handled and in particular can be brought into a position favorable for further processing, with the apparatus. Also, with the disposition of a control disk, precise control of the pressing prongs is attainable in a simple manner.

A still further advantage of this invention as explained later herein is also very important because it assures that wide foldable boxes will be reliably held while being erected.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
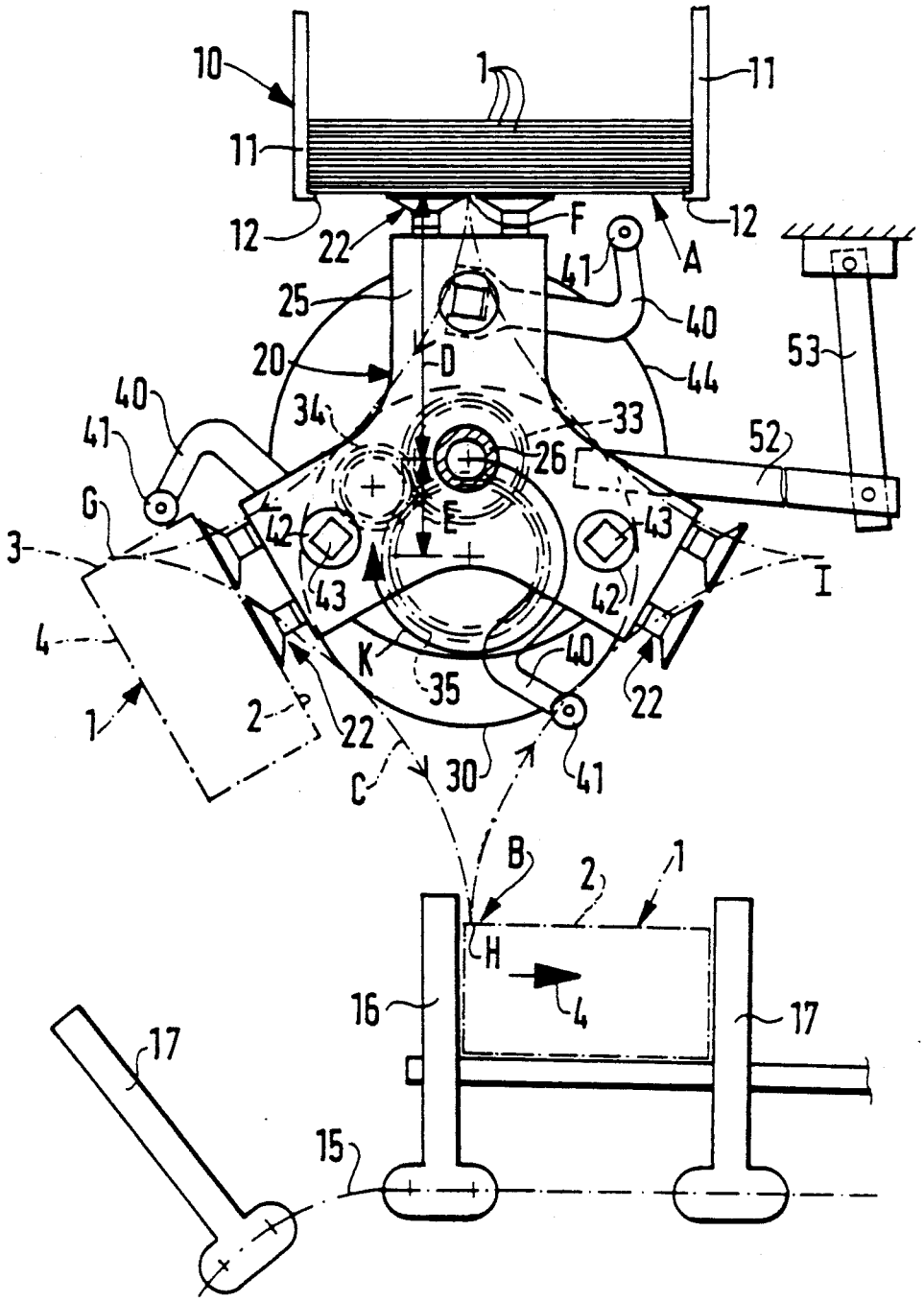
FIG. 1 is a front view of a foldable box transfer apparatus in a first working position.

The foldable box transfer apparatus is disposed between a magazine 10, having a delivery station A for foldable boxes 1 lying flat, and a conveyor apparatus 15, equipped with carriers 16, 17, having a receiving station B of a box-making machine. The magazine 10, which has lateral limitations 11 with retaining dogs 12 at the lower end, is aligned with its axis vertically to the horizontal conveyor path of the conveyor apparatus 15, so that the foldable blank boxes 1, which are now lying flat, and are to be transferred are stacked horizontally on one another in the magazine 10, with the lowermost foldable box located in the delivery station A.

Figure 3:
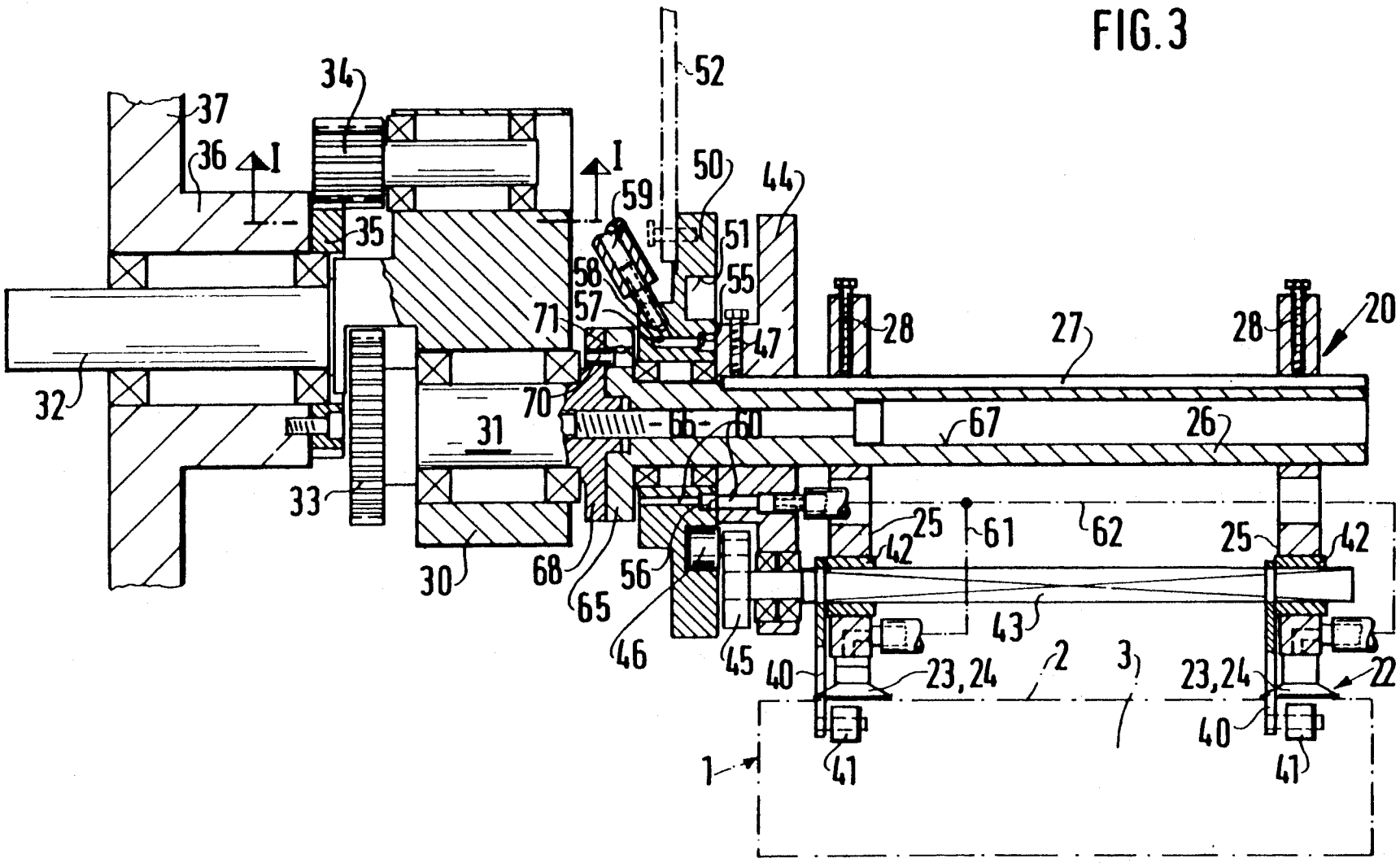
FIG. 3 shows the apparatus of FIGS. 1 and 2 in a longitudinal section along the line III—III of FIG. 2, with the part defined by the line I—I shown angularly offset.

For receiving and holding foldable boxes 1, the apparatus has three suction cups 22 on a rotor 20, which protrude, pointing radially outward, from the circumference of the rotor 20, offset by 120°. Each suction cup 22 includes two pairs of suction devices 23, 24, of which one pair each is disposed axially congruently on the ends of two holder stars 25, which are likewise secured congruently on a central shaft 26 of the rotor 20. Preferably the holder stars 25 are axially adjustable on the shaft 26, so that the spacing of the pairs of suction devices can be adapted to the length of foldable boxes to be handled. The holder stars 25 are secured against rotation by a feather key 27 in the shaft 26 and are firmly clamped with screws 28. See FIG. 3.

For transfer of foldable boxes 1 from the delivery station A of the magazine 10 to the receiving station B of the conveyor apparatus 15, the suction cups 22 are guided on a cycloid path C, in which a point approximately in the center between the two suction devices 23, 24 of one pair travels through a path having four reversal points F, G, H, I with concave arcs between them. To generate this cycloid path C, the shaft 26 of the rotor 20, disposed like a planet part, is connected coaxially with the eccentric crank element 31 of a crank 30 embodied as a planet carrier. This crank element 31, which is rotatably supported in the crank with an eccentricity E relative to the axis of the drive shaft 32 of the crank 30, has a planet gear 33, which meshes with an intermediate wheel 34 likewise rotatably supported in the crank 30. This intermediate wheel 34 also meshes with sun gear 35, which is firmly connected to the bearing eye 36 of the frame 37, in which the drive shaft 32 of the crank 30 is supported. The gear ratio between the sun gear 35 and the planet gear 33 is 4:3. The radial spacing shown by line D of FIG. 1 between the suction face of the various suction cups 22 and the axis of rotation of the rotor 20, which is coaxial with the axis of the crank element 31 of the crank 30, is on the order of three times the eccentricity E of the crank element 31 relative to the axis of rotation of the crank 30.

The spacing between the delivery station A of the magazine 10 and the receiving station B of the conveyor apparatus 15 is twice the sum of the eccentricity E of the crank 30 and the spacing D of the suction cups 22 from the axis of the rotor 20, or from the axis of the crank element 31.

With the embodiment of the planetary gear and selected dimensions as described, the centers of the suction cups 22 move over the cycloid path C described above and shown in dot-dash lines in FIGS. 1 and 2. In order to impart a motion to the suction cups 22 that upon arrival at the receiving station B has a motion component aligned with the conveyor direction (arrow L) of the conveyor apparatus 15, the crank 30 is driven counter (arrow K) to the direction of motion (arrow M) of the suction cups. In this process the crank 30 is rotated by an angle of 360° per transfer of one foldable box (or per operating cycle). For transfer of a foldable box 1 from the delivery station A to the receiving station B, the crank 30 is rotated by 540°. As a result of the embodiment of the apparatus as described, a relatively long time over a relatively short path is available to open a foldable box, and a further advantage is that because of the reversal point G on the transfer path of the foldable boxes 1, a station is available for handling the foldable boxes, as will be described hereinafter.

With the dimensions and relations given above, a quadrilateral cycloid path C is generated for the point in the center between two suction devices 23, 24 of one suction cup 22, and in this path the reversal points F, G, H, I are clearly embodied as terminal points. In some cases, however, for taking foldable boxes 1 out of the magazine 10 it is advantageous to dispose the regions of the cycloid path around the reversal point as small loops, so that the motion of the suction cups 22, terminating in a sharp point, has a transverse component superimposed on it. This has the advantage that the lowermost foldable box 1 in the magazine 10 that is to be grasped is given a transverse motion, which makes it easier to pull the grasped foldable box 1 out of the retaining dogs 12. To embody such loops in the cycloid path C of the suction cups 22, the spacing D of the face of the suction device from the axis of the rotor 20 is selected to be less than three times the eccentricity E of the crank 30, preferably being 2.75 times this eccentricity. The spacing between the delivery station A and the receiving station B should be adapted accordingly.

Either loops or flattened regions in the vicinity of the reversal points of the cycloid path C of the suction cups 22 also can be produced by rotating the sun gear 35 of the planetary gear. To this end, the sun gear 35, described above as stationary, is set into a rotational oscillation about a certain angle, this oscillation being adapted to the operating cycle of the apparatus, so that a loop is created in the vicinity of the reversal point F at the delivery station A, ad a flattened portion is created in the vicinity of the opposite reversal point H at the receiving station B. As described above, the loop is advantageous when a foldable box is taken out of the magazine. The flattened portion in the receiving station B makes it advantageous for the transferred foldable boxes to be turned over to the conveyor apparatus 15, which is moving at uniform speed, at an appropriately adapted speed.

Figure 2:
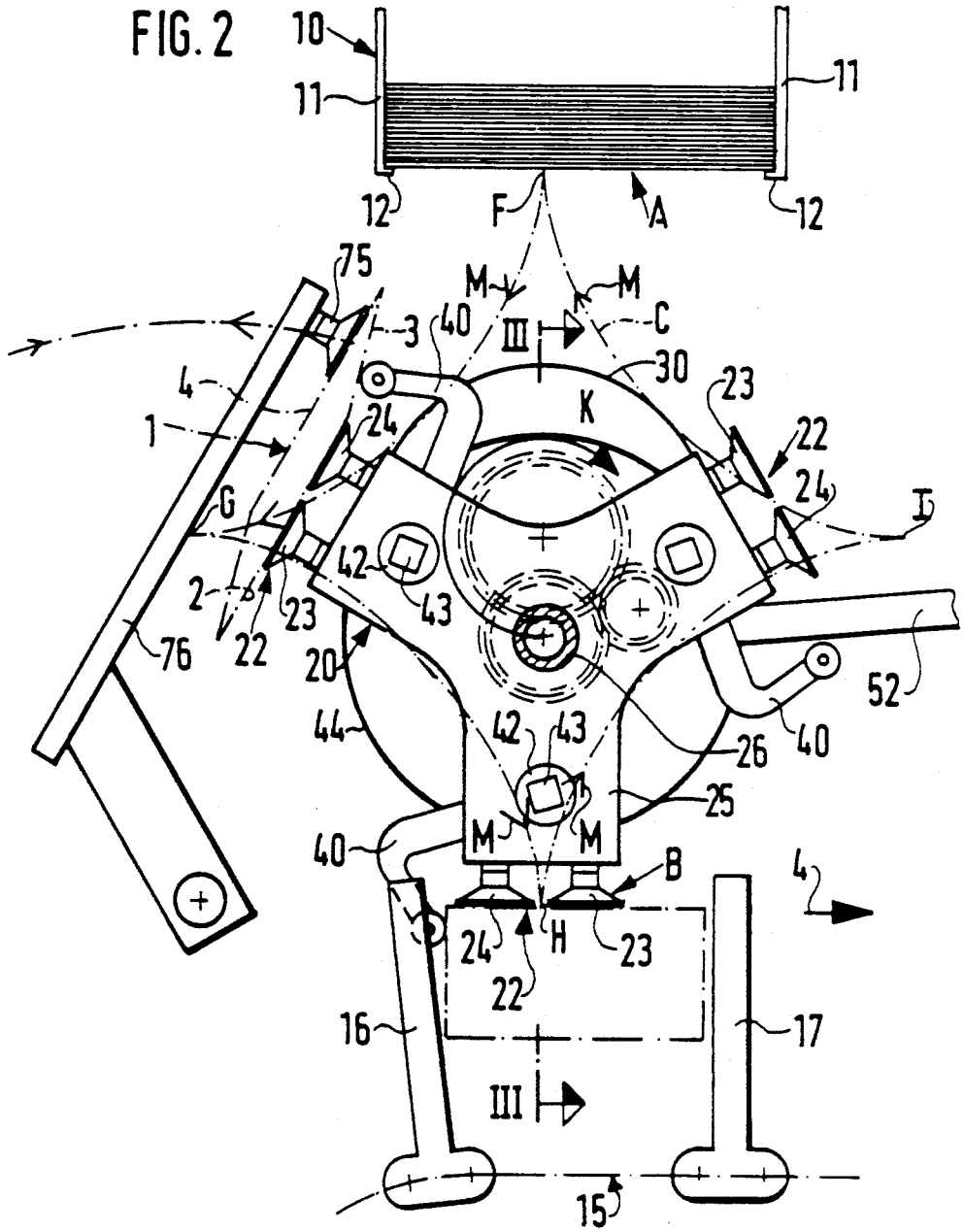
FIG. 2 shows the apparatus of FIG. 1 in a second working position.

For erecting the foldable boxes 1 taken out of the magazine 10, which are held by negative pressure by the suction cups 22 at one wall 2 of each foldable box 1, each pair of suction devices 23, 24 of the suction cups 22 has a pressing prong 40 associated with it. The pressing prongs 40, likewise disposed in pairs, are pivoted during the transfer of a foldable box 1 against the wall 3 that via a fold line borders the wall 2 to which it is connected and which is firmly held by the suction devices 23, 24, so that a roller 41 disposed on the free, bent end of the pressing prong, which rests on the wall 3, erects the foldable box 1 (FIGS. 1 and 2). The pressing prongs 40 are rotatably supported in the holder stars 25 with eyes 42 that are each penetrated in pairs by a square shaft 43 that is axially parallel with the shaft 26. For pivoting the pressing prongs 40, the square shafts 43, which are also rotatably supported in a disk 44 firmly connected to the shaft 26 by firm clamping with a screw 47 against the feather key 27, have a lever 45 and a roller 46 on their end near the crank 30; the roller 46 is guided in a cam groove 51 of a control disk 50. The control disk 50 is supported rotatably on the shaft 26 and is firmly connected to a coupler 52, which is pivotably connected to a rocker arm 53 supported on the frame, so that upon rotation of the crank 30 the control disk 50 revolves on the circular path K of the crank element 31, but does not rotate with the rotor 20 but is instead stationary relative to it. As a result, by the shape of the cam groove 51 of the control disk 50, the lever 45 is pivoted such that the pressing prongs 40 on the path segment from the delivery station A to the receiving station B pivot against the foldable box 1 held at that time by the associated suction cups 22 and pivot back again on the path segment from the receiving station B to the delivery station A. Not only can the foldable boxes be erected into a rectangle, but beyond that they can be deformed into a parallelogram, so that the fold lines between the various walls are broken and strains are thereby dissipated and the foldable blank no longer has a tendency to return to its initial state.

To control the vacuum for the suction devices 23, 24 of the suction cups 22, so that negative pressure is generated at the reversal point F at the delivery station A and venting is performed again at the opposite reversal point H of the receiving station B, arc-shaped control grooves 55, 56 open toward the disk 44 are disposed in the control disk 50 radially inside the cam groove 51 One control groove 55 is connected via bores 57, 58 to a line 59 which leads to a vacuum source, and the other control groove 56 is connected via a bore 60 to the ambient air. Congruently with the control grooves 55, 56, three bores are disposed, offset by 120°, on the disk 44, and lines 61, 62 lead from there to the suction devices 23, 24 of the associated suction cups.

Also in the exemplary embodiment, each suction cup 22 has two suction devices 23, 24 on two holder stars 25. Depending on the width of a foldable box to be transferred, it may be practical to dispose only one suction device, or more than two, on one arm of a rotating star, and depending on the length of the foldable box, to dispose only one or more than two rotating stars on the shaft 26 of the rotor 20.

To enable rapid conversion of the apparatus upon a change to a different size of foldable box, the shaft 26 that carries the rotor 20, disk 44 and control disk 50, is embodied as an interchangeable part. To this end, it has a flange 55 on its end near the crank 30, which flange is clamped, by means of a screw 66 in a stepped axial bore 67 of the shaft 26, against an adapted flange 68 on the crank element 31. A protruding indexing pin 70 on the flange 68 and a corresponding fitted bore 71 on the flange 65 assure a correct angular position of the rotor 20 on the crank element 30.

For reliable erecting of foldable boxes that are difficult to open, because of either the rigidity of the packaging material or the ratio among their sides, a counterpart suction device 75 (FIG. 2) can additionally be associated with the rotor 20. The counterpart suction device 75, secured on a lever 76, is disposed in the region of the reversal point G located between the delivery station A and the receiving station B. Its lever 76 is moved in controlled fashion such that upon arrival of a foldable box I at the reversal point G it grasps the wall 4 opposite the wall 2 grasped by the suction devices 23, 24 of a suction head 22, and by a motion pulls this wall away from the grasped wall 2. The counterpart suction device 75 reinforces the pressing prongs 40 and assures their action.

The possibility of disposing folding elements, guide rails and shunts along the transfer path of the foldable boxes, particularly in the segment from the reversal point G to the receiving station B, should also be noted; these elements move fold tabs which protrude from the openings of the foldable boxes, into the most favorable positions for further handling of the foldable boxes.

The foregoing relates to a preferred exemplary embodiment of the invention, it being understood that other variants and embodiments thereof are possible within the spirit and scope of the invention, the latter being defined by the appended claims.

WHAT IS CLAIMED AND DESIRED TO BE SECURED BY LETTERS PATENT OF THE UNITED STATES IS:

1. A box erecting apparatus for removing folded blank boxes (1), from a delivery station (A) and transferring them to a receiving station (B), comprising a plurality of suction cups (22) a rotor (20) carrying said suction cups (22) which protrude outward, said suction cups being distributed uniformly over a circle; a crank (30) rotatably supporting said rotor on an eccentric shaft (31), said crank being arranged to rotate uniformly counter to the direction of conveyance of the suction cups; and a planetary gear assembly, said planetary gear assembly having a sun gear (35) disposed coaxially with the axis of rotation of said crank, a planet gear (33) that is firmly connected to the rotor and rotatable on the eccentric axis of the crank, and an intermediate gear 34 arranged to mesh with both said gears; said cups, rotor, crank, and gear assembly being arranged so that said suction cups revolve on a self-contained cycloid path (C) including four sharply pointed reversal points (F, G, H, T) and arc therebetween, said delivery station (A) and receiving station (B) being disposed at opposite reversal points (F, H) of said cycloid path; that three suction cups are disposed offset by 120° on the rotor (20); that the gear ratio between the sun gear (35) and the planet gear (33) is 4:3; and that the radial spacing between the suction clips and the axis of the rotor (20) is on the order of three times the eccentricity (E) of the crank (30).

2. An apparatus as defined by claim 1, in which the spacing between the suction cups (22) and the axis of rotation of the rotor (20) is less than three times the eccentricity (E) of the crank (30), whereby the cycloid path (C) of the suction cups forms a loop in the vicinity of the reversal points (F, G, H, I).

3. An apparatus as defined by claim 1, in which the sun gear (35) is rotated backward and forward incrementally about a predetermined angle, so that at least the region about the reversal point (H) of the cycloid path (C) is flattened in the vicinity of the delivery station (B).

4. An apparatus as defined by claim 1, in which a pressing finger (40) is associated with each suction cup (22) rotatably supported relative thereto in the rotor (20), said finger being pivoted against one wall (3) of a foldable box (1), said wall being connected to the wall (2) firmly held by the suction cup via a fold line.

5. An apparatus as defined by claim 2, in which a pressing finger (40) is associated with each suction cup (22) rotatably supported relative thereto in the rotor (20), said finger being pivoted against one wall (3) of a foldable box (1), said wall being connected to the wall (2) firmly held by the suction cup via a fold line.

6. An apparatus as defined by claim 3, in which a pressing finger (40) is associated with each suction cup (22) rotatably supported relative thereto in the rotor (20), said finger being pivoted against one wall (3) of a foldable box (1), said wall being connected to the wall (2) firmly held by the suction cup via a fold line.

7. An apparatus as defined by claim 4, in which the pressing prongs (40) are pivoted incrementally by a control cam (50, 51) via control levers (45), which are supported rotatably on the eccentric shaft (26, 31) of the crank (30) coaxially with the rotor (20).

8. An apparatus as defined by claim 5, in which the control cam (50, 51) is secured to a coupler (52) that is pivotably connected to a rocker arm (53).

9. An apparatus as defined by claim 1, in which the rotor (20) along with the control cam (50, 51) is flanged as an interchangeable part relative to the crank (30, 31).

10. An apparatus as defined by claim 2, in which the rotor (20) along with the control cam (50, 51) is flanged as an interchangeable part relative to the crank (30, 31).

11. An apparatus as defined by claim 3, in which the rotor (20) along with the control cam (50, 51) is flanged as an interchangeable part relative to the crank (30, 31).

12. An apparatus as defined by claim 4, in which the rotor (20) along with the control cam (50, 51) is flanged as an interchangeable part relative to the crank (30, 31).

13. An apparatus as defined by claim 5, in which the rotor (20) along with the control cam (50, 51) is flanged as an interchangeable part relative to the crank (30, 31).

14. An apparatus as defined by claim 6, in which the rotor (20) along with the control cam (50, 51) is flanged as an interchangeable part relative to the crank (30, 31).

15. An apparatus as defined by claim 1, in which each suction head (22) has at least two suction devices (23, 24) disposed in series in the conveying direction and arranged in a common plane.

16. An apparatus as defined by claim 2, in which each suction head (22) has at least two suction devices (23, 24) disposed in series in the conveying direction and arranged in a common plane.

17. An apparatus as defined by claim 3, in which each suction head (22) has at least two suction devices (23, 24) disposed in series in the conveying direction and arranged in a common plane.

18. An apparatus as defined by claim 4, in which each suction head (22) has at least two suction devices (23 24) disposed in series in the conveying direction and arranged in a common plane.

19. An apparatus as defined by claim 5, in which each suction head (22) has at least two suction devices (23, 24) disposed in series in the conveying direction and arranged in a common plane.

20. An apparatus as defined by claim 6, in which each suction head (22) has at least two suction devices (23, 24) disposed in series in the conveying direction and arranged in a common plane.

* * * * *